US005806347A

United States Patent [19]

Ando'

[11] Patent Number: 5,806,347

[45] Date of Patent: Sep. 15, 1998

[54] MODIFIED SUB-NEEDLE WITH ASSOCIATED ACTUATION ELEMENTS FOR CIRCULAR KNITTERS

[75] Inventor: Jan Ando', Scandicci, Italy

[73] Assignee: Matec S.R.L., Sandicci, Italy

[21] Appl. No.: 888,909

[22] Filed: Jul. 7, 1997

[30] Foreign Application Priority Data

Sep. 5, 1996 [IT] Italy ..... BO96A0446

[51] Int. Cl.[6] ..... D04B 35/02

[52] U.S. Cl. ..... 66/116; 66/8; 66/115

[58] Field of Search ..... 66/8, 7, 57, 64, 66/115, 116, 121

[56] References Cited

U.S. PATENT DOCUMENTS 3,535,892 10/1970 Schmidt et al. ..... 66/57 X
4,905,484 3/1990 Schindler ..... 66/115 X
5,369,965 12/1994 Shima et al. ..... 66/64
5,694,792 12/1997 Nakamori et al. ..... 66/64 X

*Primary Examiner*—John J. Calvert
*Attorney, Agent, or Firm*—Welsh & Katz, Ltd.

[57] ABSTRACT

A modified sub-needle with associated actuation elements for circular stocking machines, which is constituted by a lower sub-needle provided with a selection heel and by an intermediate sub-needle provided with an upper heel and a lower heel; the top of the lower sub-needle has a lower external region and an upper internal region for the resting of the base of the intermediate sub-needle; there is provided a first bolt cam for lifting the lower heel of the intermediate sub-needle which is adapted to selectively move the oscillating base of the intermediate sub-needle so that it rests in the lower external region or in the upper internal region of the lower sub-needle; and there is provided a second bolt cam for lowering the upper heel of the intermediate sub-needle; the selections and longitudinal movements performed by the intermediate sub-needle being suitable to reduce the longitudinal strokes required of the sub-needles and the angular extent of the bolt cams and of the selection cams.

1 Claim, 2 Drawing Sheets

MODIFIED SUB-NEEDLE WITH ASSOCIATED ACTUATION ELEMENTS FOR CIRCULAR KNITTERS

BACKGROUND OF THE INVENTION

The present invention relates to a modified sub-needle with associated actuation elements for circular knitters, in particular for sock and stocking knitters.

Conventional circular sock and stocking knitters, called generically stocking machines have sub-needles which allow to make the needles rise and fall at various levels in particular angular positions of the cylinder: accordingly, the sub-needles are provided with heels which are selected and are moved longitudinally with respect to the cylinder by interference, during the rotation of the cylinder, with cam profiles, triangular stitch cams, bolt cams and countercams: the profiles of these components must have a rather smooth shape in order to avoid damaging the heels, and therefore the cylinder angle affected by each one of these profiles is usually rather wide; this occurs also in relation to the fact that in order to produce particular stitches or during certain knitting steps the needle must move longitudinally to the cylinder along paths which are possibly rather long in order to gradually move from the chord level to the loop, stitch or reinforced-stitch level.

Accordingly, only a very small number of selections can be performed in one full rotation.

SUMMARY OF THE INVENTION

A principal aim of the present invention is to obviate the above-described drawback of conventional sub-needles, i.e., to provide a modified sub-needle with associated actuation elements for circular stocking machines which allows to perform a very large number of selections during each rotation of the cylinder.

Within the scope of this aim, an object of the present invention is to achieve the above aim with a structure which is simple, relatively easy to produce in practice, safe in use, effective in operation, and has a relatively low cost.

This aim and these objects are all achieved by the present modified sub-needle with associated actuation elements for circular knitters, in particular stocking machines, characterized in that it is constituted by a lower sub-needle provided with a selection heel and by an intermediate sub-needle provided with an upper heel and a lower heel; in that the top of the lower sub-needle has a lower external region and an upper internal region for the resting of the base of the intermediate sub-needle; in that there is provided a first bolt cam for lifting the lower heel of the intermediate sub-needle which is adapted to selectively move the oscillating base of the intermediate sub-needle so that it rests in the lower external region or in the upper internal region of the lower sub-needle; and in that there is provided a second bolt cam for lowering the upper heel of the intermediate sub-needle; the selections and longitudinal movements performed by the intermediate sub-needle being suitable to reduce the longitudinal strokes required of the sub-needles and the angular extent of the bolt cams and of the selection cams, in order to distribute the lifting and lowering strokes of the needle between the lower sub-needle and the intermediate sub-needle and to distribute the required angular extent among the first and second bolt cams and the selection cams.

BRIEF DESCRIPTION OF THE DRAWINGS

Further characteristics and advantages of the present invention will become apparent from the following detailed description of a preferred but not exclusive embodiment of a modified sub-needle with associated actuation elements for circular stocking machines according to the invention, illustrated only by way of non-limitative example in the accompanying drawings, wherein.

DESCRIPTION OF THE PREFERRED EMBODIMENTS

Figures 1A, 1B, 1C, 1D, 1E:
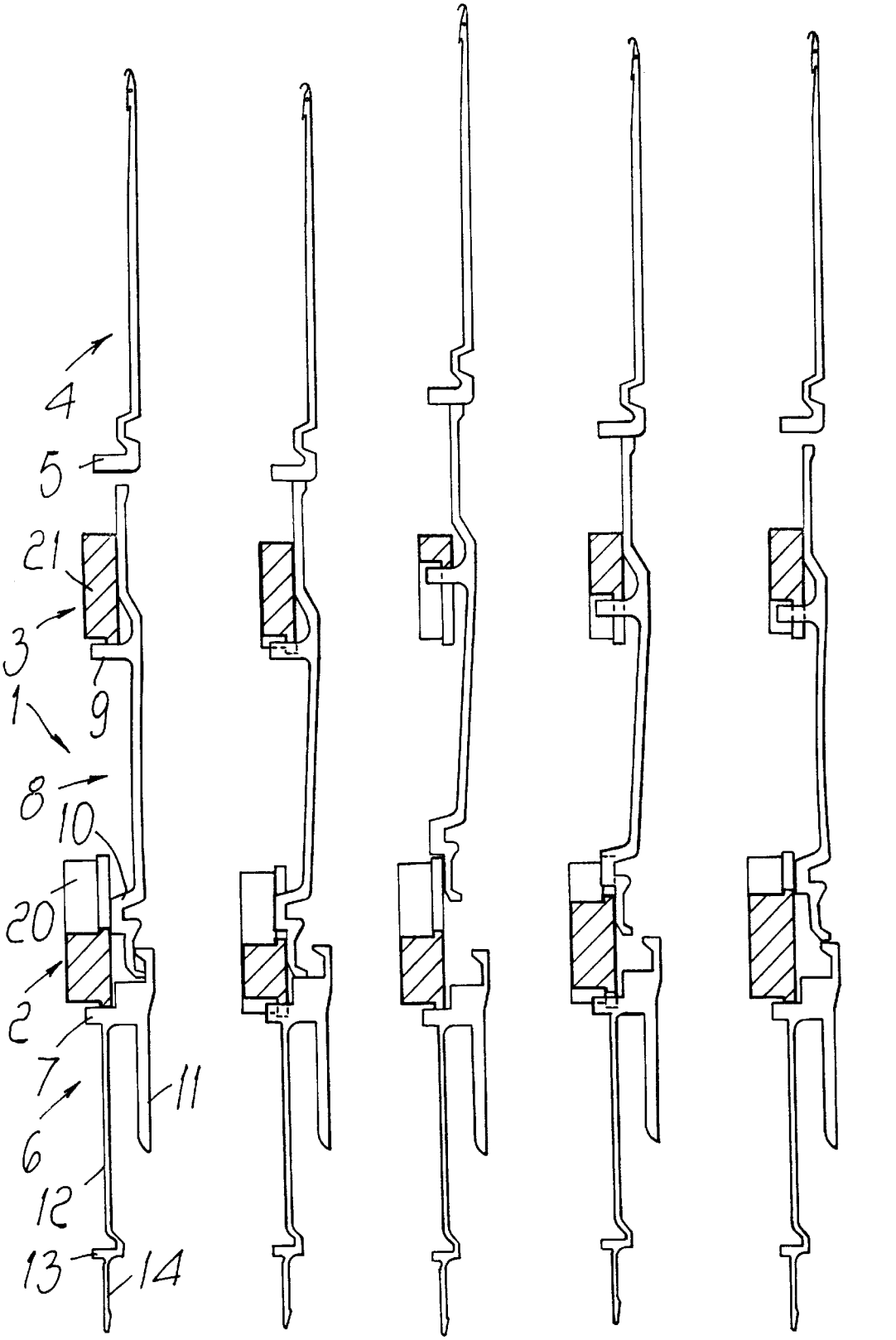
FIGS. 1A–1E are side views of a modified sub-needle with associated actuation elements for circular stocking machines according to the present invention, in different operating steps.
Figure 2:
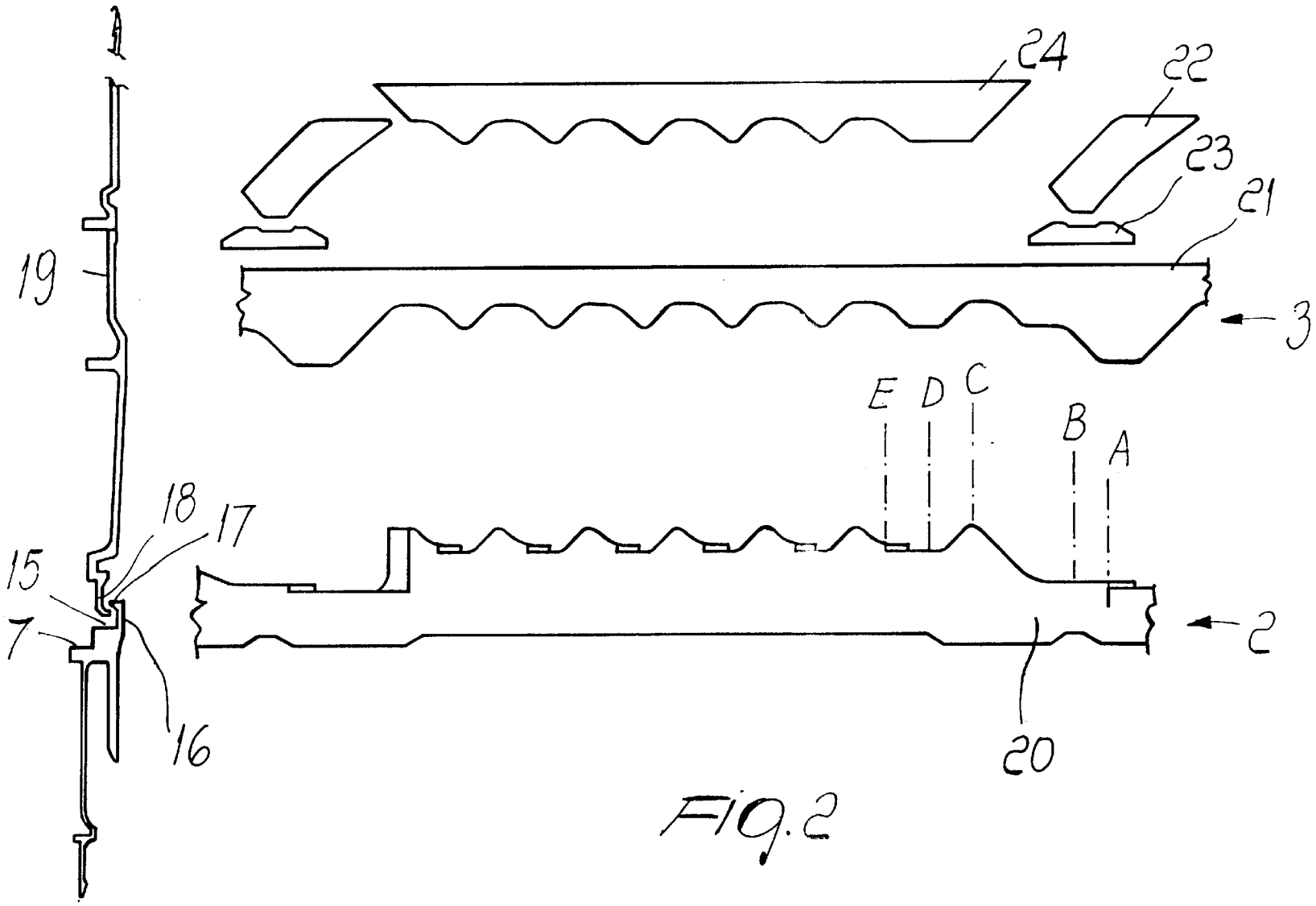
FIG. 2 is a symbolic view projected onto a plane, of the actuation elements of the needle and modified sub-needle according to the present invention.

With particular reference to the above figures, the reference numeral 1 generally designates a modified sub-needle and the reference numerals 2 and 3 designate corresponding actuation elements for circular stocking machines according to the invention.

The reference numeral 4 designates a conventional needle which has a heel 5; the sub-needle 1 is constituted by a lower sub-needle 6, which has a selection heel 7, and by an intermediate sub-needle 8, which has an upper heel 9 and a lower heel 10.

The lower sub-needle 6 has a guiding tab 11 and an elastic extension 12 provided, in a downward region, with a heel 13 and an electromagnetic selection end 14.

The top of the lower sub-needle has a lower external region 15 and an upper internal region 16 which forms a sort of tooth 17 for the resting of the base of the intermediate sub-needle 8.

The intermediate sub-needle 8 forms, in a downward region, a curved extension 18 in which the concavity is directed towards the tooth 17; said intermediate sub-needle 8 also forms, in an upward region, an extension 19 which rests against the lower end of the needle.

The reference numeral 20 designates a first bolt cam for raising the lower heel of the intermediate sub-needle 8, which is adapted to selectively move the oscillating base of the intermediate sub-needle so that it rests in the lower external region or in the upper internal region of the lower sub-needle; the reference numeral 21 designates a second bolt cam for lowering the upper heel of the intermediate sub-needle.

The reference numeral 22 designates the lowering cams of the heel 5 of the needle, the reference numeral 23 designates the countercams, and the reference numeral 24 designates the corresponding bolt cams.

The selections and the longitudinal movements performed by the intermediate sub-needle are suitable to reduce the longitudinal strokes which the sub-needles must perform and the angular extent of the bolt cams and selection cams, in order to distribute the strokes for the lifting and lowering of the needle between the lower and intermediate sub-needles and to distribute the required angular extent among the first and second bolt cams and the selection cams: it is evident that the profiles of the bolt cams form a plurality of sinusoidal lines or bumps instead of substantially linear portions.

It has thus been shown that the present invention achieves the intended aim and objects.

The invention thus conceived is susceptible of numerous modifications and variations, all of which are within the scope of the inventive concept.

All the details may also be replaced with other technically equivalent ones.

In practice, the materials employed, as well as the shapes and the dimensions, may be any according to requirements without thereby abandoning the scope of the protection of the appended claims.

What is claimed is:

1. A modified sub-needle with related actuation elements for controlling lifting and lowering strokes of a needle at a cylinder of a circular knitting machine, the modified sub-needle comprising:

a lower sub-needle including a top portion, a selection heel, a lower external region and an upper internal region thereof, said lower external and upper internal regions being provided at the lower sub-needle top;

an intermediate sub-needle including an upper heel, a lower heel and an oscillating base thereof, said base resting at the lower sub-needle top portion; and said actuation elements comprising:

needle selection cams extending over an angular extent of the machine cylinder for performing selections of corresponding needles and sub-needles;

a first bolt cam extending over an angular extent of the machine cylinder for lifting the lower heel of said intermediate sub-needle so as to selectively move said oscillating base thereof while resting at any of said lower external and upper internal regions of the lower sub-needle;

a second bolt cam extending over an angular extent of said machine cylinder for lowering the upper heel of said intermediate sub-needle, whereby said needle and sub-needles performing longitudinal lifting and lowering stroke movements with respect to said cylinder, the selections and longitudinal movements performed by said intermediate sub-needle reducing the sub-needles longitudinal strokes and the angular extent of the bolt cams and selection cams, the lifting and lowering needle strokes being consequently distributable between said lower sub-needle and said intermediate sub-needle, and said angular extent being distributable between said first and second bolt cams and said selection cams.

* * * * *